United States Patent [19]

Mendyk

[11] 4,241,466

[45] Dec. 30, 1980

[54] SAFETY BED SHEET

[76] Inventor: Kay S. Mendyk, 1022 Forest Rd., Schenectady, N.Y. 12303

[21] Appl. No.: 47,812

[22] Filed: Jun. 12, 1979

[51] Int. Cl.[3] ..... A47G 9/00

[52] U.S. Cl. ..... 5/497; 5/494; 5/500

[58] Field of Search ..... 5/485, 488, 494–500

[56] References Cited

U.S. PATENT DOCUMENTS

| | | | |
|---|---|---|---|
| 2,525,713 | 10/1950 | North | 5/494 |
| 2,537,652 | 1/1951 | Churchill | 5/499 |
| 2,662,234 | 12/1953 | Citron | 5/497 |
| 3,965,504 | 6/1976 | Ainsworth | 5/496 |
| 4,145,778 | 3/1979 | Ferrante et al. | 5/496 |

*Primary Examiner*—Casmir A. Nunberg

[57] ABSTRACT

Discloses a safety bed sheet for use in preventing a child or elderly person from falling out of bed or from kicking off the covering blanket while sleeping. The safety bed sheet is in the form of a fitted bottom sheet and a superposed top sheet that is the same width as the bottom sheet's upper surface but cut-off both on the foot end and the head end, and, hence is shorter in length than the bottom sheet. The top and bottom sheets are stitched together along one of their common, longitudinal marginal edges, and stitched together a substantial distance along the other of their common, longitudinal marginal edges with a remaining unstitched-together portion having a separable fastening device.

1 Claim, 1 Drawing Figure

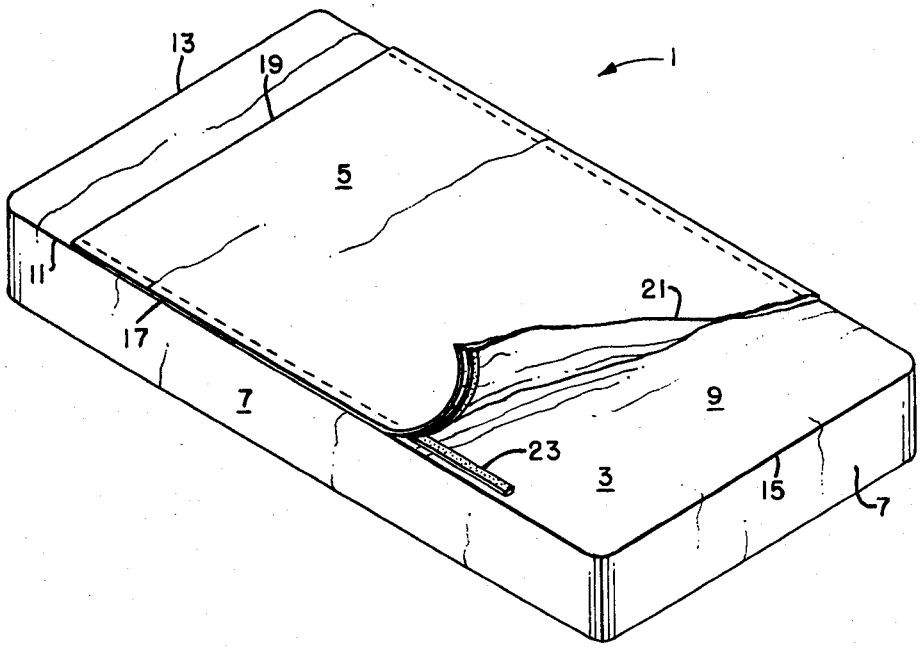
13
19
1
5
11
21
17
7
9
23
3
15
7

SAFETY BED SHEET

BRIEF SUMMARY OF THE INVENTION

This invention relates to the field of bed clothing and more particularly restraining sheets. The object of this invention is to provide a safety bed sheet for use in preventing a sleeping child or elderly person from falling out of bed or kicking off the covering blanket. The safety bed sheet is in the form of a fitted bottom sheet and a superposed top sheet that is the same width as the bottom sheet's upper surface but cut-off both on the foot end and the head end, and, hence is shorter in length than the bottom sheet. The top and bottom sheets are stitched together along one of their common, longitudinal marginal edges, and stitched together a substantial distance along the other of their common, longitudinal marginal edges with a remaining portion having a separable fastening device. dr

BRIEF DESCRIPTION OF THE DRAWING

This object and other objects of the invention should be discerned and appreciated by reference to the detailed description taken in conjunction with the drawing which is a perspective view of the invention.

DETAILED DESCRIPTION

With reference to the drawing, reference numeral 1 generally refers to the safety bed sheet comprising a fitted bottom sheet generally referred to by reference numeral 3 and top sheet 5 with the bottom sheet 3 disposed in secured relationship with a mattress and with said bottom sheet 3 defining side walls 7 and an upper surface 9, longitudinal marginal edges 11, and foot-end and head-end marginal edges 13 and 15, respectively.

The superposed top sheet 5 is the same width as the bottom sheet's upper surface 9 but is cut-off both on the foot end and the head end, and hence is shorter in length than the bottom sheet 3.

The top sheet 5 has longitudinal marginal edges 17, and foot-end and head-end marginal edges 19 and 21, respectively.

As shown with respect to the cut-off portions of both the foot end and the head end: the distance between the head-end marginal edge 15 of the bottom sheet 3 and the head-end marginal edge 21 of the top sheet 5 is greater than the distance between the foot-end marginal edge 13 of the bottom sheet 3 and the foot-end marginal edge 19 of the top sheet 5.

As shown, the bottom sheet 3 and top sheet 5 are stitched together along the entire distance of one of the common, longitudinal marginal edges 11 and 17; and the bottom sheet 3 and top sheet 5 are stitched together a substantial distance along the other of their common, longitudinal marginal edges 11 and 17 and have a remaining portion approximately 14 inches long of such common, longitudinal marginal edges that have a separable fastening device 23 such as of the velcro-type.

In using the invention, the bed is made up in the conventional manner with the fitted bottom sheet 3 appropriately disposed on a mattress and covered with a blanket. The top sheet 5 being cut-off on its foot end allows the bed to be made neater for the reason that there are no loose ends to tuck under the mattress as would be the case with a conventional flat, top sheet. A point of further clarification: although the width of the superposed top sheet 5 is the same width as the width of the bottom sheet's upper surface 9, enough material is allowed in the width of the top sheet 5 so that such child or elderly person can move freely from side-to-side. After the child disposes himself or is disposed beneath the top sheet 5, such velcro-type device 23 is appropriately fastened. By use of this safety bed sheet invention, the child or elderly person has a restful sleep because the child or elderly person can move from side-to-side without falling out of bed or without fear of falling off the bed and has a restful sleep because he remains warm for he remains covered with the blanket.

Having thusly described my invention, I claim:

1. A safety bed sheet comprising a fitted bottom sheet and a superposed top sheet; said bottom sheet, when disposed in secured relationship with a mattress, defining side walls and an upper surface having length and width, longitudinal marginal edges, and foot-end and head-end marginal edges, said top sheet having a length less than the length of said bottom sheet's upper surface, said top sheet having longitudinal marginal edges, and foot-end and head-end marginal edges, the distance between the head-end marginal edge of said bottom sheet and the head-end marginal edge of said top sheet being greater than the distance between the foot-end marginal edge of said bottom sheet and the foot-end marginal edge of said top sheet, said bottom sheet and top sheet being stitched together along the entire distance of one of their common, longitudinal marginal edges, said bottom sheet and top sheet being stitched together a substantial distance along the other of their common, longitudinal marginal edges and having a remaining portion of said common, longitudinal marginal edges having a separable fastening device such as of the velcro-type, said superposed top sheet having enough material allowed in its width to afford a person freedom of movement and permit such person to move freely from side to side.

* * * * *